US011180966B2

(12) United States Patent
Saraya et al.

(10) Patent No.: US 11,180,966 B2
(45) Date of Patent: Nov. 23, 2021

(54) METHODS AND SYSTEMS FOR A SUB WITH INTERNAL COMPONENTS THAT SHIFT TO FORM A SEAT ALLOWING AN OBJECT TO LAND ON THE SEAT AND FORM A SEAL

(71) Applicant: Vertice Oil Tools, Missouri City, TX (US)

(72) Inventors: Mohamed Ibrahim Saraya, Sugar Land, TX (US); Alex Goodwin, Houston, TX (US)

(73) Assignee: Vertice Oil Tools Inc., Stafford, TX (US)

( * ) Notice: Subject to any disclaimer, the term of this patent is extended or adjusted under 35 U.S.C. 154(b) by 193 days.

(21) Appl. No.: 16/550,137

(22) Filed: Aug. 23, 2019

(65) Prior Publication Data

US 2021/0054705 A1 Feb. 25, 2021

(51) Int. Cl.

| | |
|---|---|
| ***E21B 23/10*** | (2006.01) |
| ***E21B 33/12*** | (2006.01) |
| ***E21B 23/06*** | (2006.01) |

(52) U.S. Cl.

CPC ..... *E21B 23/10* (2013.01); *E21B 23/06* (2013.01); *E21B 33/1208* (2013.01); *E21B 2200/06* (2020.05)

(58) Field of Classification Search

CPC ..... E21B 23/10; E21B 33/1208; E21B 23/06; E21B 2200/06; E21B 34/14

See application file for complete search history.

(56) References Cited

U.S. PATENT DOCUMENTS

| | | | | |
|---|---|---|---|---|
| 2009/0044948 | A1* | 2/2009 | Avant | E21B 34/14 166/329 |
| 2011/0278017 | A1* | 11/2011 | Themig | E21B 34/14 166/373 |
| 2012/0012771 | A1* | 1/2012 | Korkmaz | F16K 15/183 251/315.07 |
| 2012/0168163 | A1* | 7/2012 | Bertoja | E21B 23/04 166/297 |
| 2014/0060813 | A1* | 3/2014 | Naedler | E21B 43/26 166/135 |
| 2014/0138101 | A1* | 5/2014 | Arabsky | E21B 23/004 166/387 |
| 2014/0166912 | A1* | 6/2014 | Larisey | E21B 43/26 251/61 |
| 2014/0251629 | A1* | 9/2014 | Castro | E21B 34/14 166/318 |
| 2014/0318816 | A1* | 10/2014 | Hofman | E21B 34/14 166/386 |
| 2014/0345876 | A1* | 11/2014 | Coon | E21B 43/26 166/373 |

* cited by examiner

*Primary Examiner* — Steven A MacDonald
(74) *Attorney, Agent, or Firm* — Pierson IP, PLLC

(57) ABSTRACT

A sub with internal components that are configured to shift, wherein a plurality of subs may be run in hole with the same inner diameter.

26 Claims, 15 Drawing Sheets

METHODS AND SYSTEMS FOR A SUB WITH INTERNAL COMPONENTS THAT SHIFT TO FORM A SEAT ALLOWING AN OBJECT TO LAND ON THE SEAT AND FORM A SEAL

BACKGROUND INFORMATION

Field of the Disclosure

Examples of the present disclosure relate to systems and methods for a sub with internal components that are configured to shift, wherein a plurality of subs may be run in hole with the same or similar inner diameter. More specifically, embodiments disclose internal components that shift responsive to a shifting tool moving the components, wherein the shifting tool may be configured to shear at multiple locations. Responsive to the internal components shifting, an internal diameter within the sub is reduced, allowing for an object to land on the reduced inner diameter, forming a seal and isolating the zones below the sub from zones above the sub.

Background

Hydraulic fracturing is the process of creating cracks or fractures in underground geological formations. After creating the cracks or fractures, a mixture of water, sand, and other chemical additives, is pumped into the cracks or fractures to protect the integrity of the geological formation preventing its closure and enhance production of the natural resources. The cracks or fractures are maintained opened by the mixture, allowing the natural resources within the geological formation to flow into a wellbore, where it is collected at the surface.

In order to isolate zones from fracturing, either conventional frac plugs or sliding sleeves are used.

Conventionally, when Frac Plugs are used, a frac plug is lowered to a required depth mounted below a perforating guns. At the required depth, the Frac plug is set and perforating guns are fired. A ball is then dropped to isolate the zone(s) below the frac plug from the newly perforated and untreated zones. This sequence is repeated throughout the well starting from toe to heel. This requires a multitude of Frac Plugs in the well bore after concluding the fracturing operation that would require milling to clean the wellbore Conventionally when sliding sleeves are used, the sliding sleeves are run as part of the casing and are activated by dropping a specific size ball for each sliding sleeve. This limits a number of sleeves can be used.

Thus, conventional wellbores force fracturing to use Frac Plugs that causes obstructions to production flow and require cleaning post fracing operation or the frac sleeves that have to be installed with the casing and have entry point limitation.

Accordingly, needs exist for systems and methods utilizing a sub with internal components that are configured to shift, wherein a plurality of subs may be run in hole with the same inner diameter. Responsive to the internal components shifting, an internal diameter within the sub is reduced, allowing for an object to land on the reduced inner diameter, forming a seal and isolating the zones below the sub from zones above the sub.

SUMMARY

Embodiments disclosed herein describe fracturing systems and methods for a sub with internal components that are configured to shift, wherein a plurality of subs may be run in hole with the same or similar inner diameter. The subs may be dummy subs with internal and embedded components, which are run in hole with the same inner diameters. The dummy subs may include an outer component, an activation sleeve, and seat. The dummy subs may be configured be activated via a shifting tool, which reduces the inner diameter across the dummy sub. This allows an object to be positioned on the reduced inner diameter, forming a seal, and isolating zones on opposite sides of the object The outer component may be configured to be positioned adjacent to the activation sleeve and the expandable component. The outer component may include a first groove, recess, indentation, etc. that is configured to receive an expandable fastener to secure the activation sleeve in place.

The activation sleeve may be configured to move along a linear axis along an inner circumference of the outer component, and be positioned adjacent to the seat. The activation sleeve may include a second groove and a third groove.

The second groove may be positioned on an outer diameter of the activation sleeve, and may be configured to initially house the expandable fastener while the activation sleeve is in a first position. In the first position, the second groove may be configured to be misaligned with the first groove. Responsive to moving the activation sleeve to a second position, the first groove and the second groove may become aligned, and the expandable fastener may extend across the first and second grooves to lock the activation sleeve in place. Upon moving the activation sleeve from the first position to the second position, the activation sleeve may apply force against the seat to expand the seat and/or collapse the inner diameter across the seat.

The third groove may be positioned on an inner diameter of the activation sleeve and may be configured to interface with the shifting tool. The geometry of the third groove may allow the shifting tool to move downhole, but restrict the upward movement of the shifting tool. The restriction of the movement of the shifting tool may cause shear pins associated with the shifting tool to shear and/or allow the shifting tool to be pulled out of hole without shifting a second activation sleeve associated with a second dummy sub.

The seat may be positioned adjacent to the outer component of the activation sleeve. Responsive to the activation sleeve moving to the second position, the seat may collapse, causing the inner diameter across the seat to decrease from a first inner diameter to a second inner diameter, wherein the second inner diameter is smaller than the first inner diameter. This may enable a ball or other object to be positioned on the seat.

The shifting tool may be configured to move the activation sleeve from the first position to the second position. The shifting tool may include a first coupling mechanism, second coupling mechanism, outer projection, and inner projection. The shifting tool may be run in hole in a first mode, wherein the first coupling mechanism and the second coupling mechanism, such as shear pins, are coupled to an inner core.

The first coupling mechanism may be a shear screw, pin, etc., that is configured to temporarily couple the shifting tool to the inner body. The first coupling mechanism may be pre-loaded, wherein movement of the shifting tool may be configured to shear, break, etc. the first coupling mechanism.

The second coupling mechanism may be a shear screw, pin, etc. that is configured to temporarily couple the shifting tool the inner body. The second coupling mechanism may not be pre-loaded, and may become loaded when the first coupling mechanism is sheared Responsive to the second coupling mechanism being loaded, the second coupling mechanism may be sheared.

The outer projection may be positioned on an outer face of the shifting tool. The outer projection may have a profile that allows the shifting tool to move downhole, and interface with the activation sleeve and ball seat without shifting the activation sleeve while moving in the downhole direction. Responsive to aligning the outer projection with the third groove within the activation sleeve, the shifting tool may be configured to move the activation sleeve from the first position to the second position. This may allow the seat to collapse, and the first coupling mechanism to shear. After the seat collapse and the outer projection is positioned adjacent to the seat, the shifting tool may be moved in the first direction to load the second coupling mechanism. When the second coupling mechanism is loaded and the shifting tool receives a force in the first direction, the second coupling mechanism may shear. This may serve as an indicator that the seat has expanded when the shifting tool is retrieved back to surface.

The inner projection may be positioned on an inner circumference of the shifting tool. The inner projection may be configured to interface with a first ledge on the inner core when in the second mode, and with a second ledge on the inner core when in the third mode. When the inner projection is interfaced with the first ledge while the shifting tool is in the second mode, the inner diameter across the shifting tool may decrease from a first diameter to a second diameter. When the inner projection is interfaced with the second ledge and the shifting tool is in the third mode, the inner diameter across the shifting tool may decrease from the second diameter to a third diameter. Further, when the inner projection is interfaced with the first or second ledge, mechanical forces may be transferred between the inner body and the shifting tool. This may allow the inner body to be pulled to shear the first coupling mechanism, shear second coupling mechanism, and pulled out of hole.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
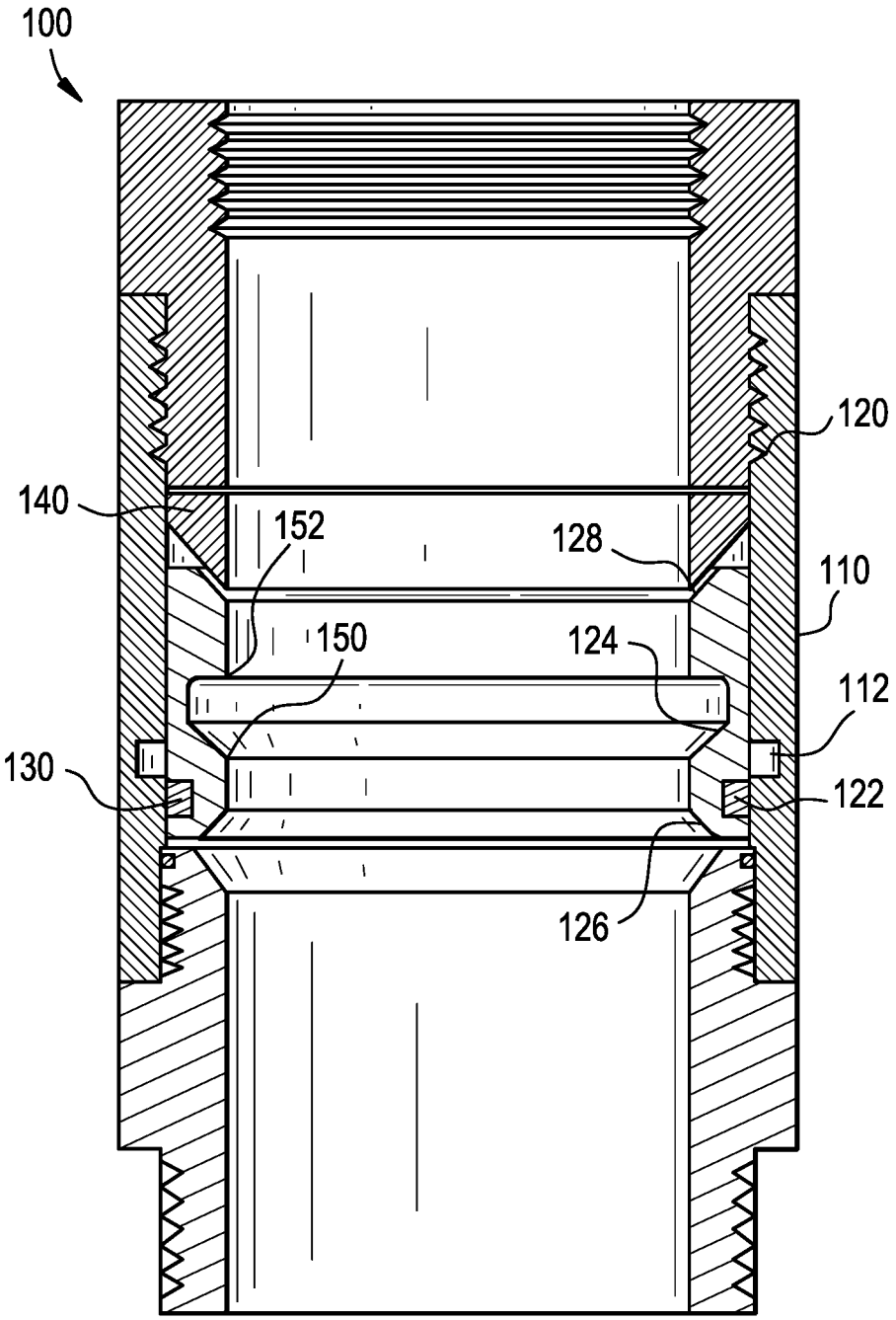
FIG. 1 depicts a blank sub, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a blank sub 100, according to an embodiment. A single wellbore may include a plurality of blank subs 100, which may be run in hole with the same or similar inner diameters. Blank sub 100 may include an outer component 110, activation sleeve 120, expandable fastener 130, and seat 140.

Outer component 110 may have an inner circumference that is configured to be positioned adjacent to activation sleeve 120, expandable fastener 130, and seat 140 in a first mode. Outer component 110 may include a first groove 112, recess, slot, indentation, etc. (referred to hereinafter individually and collectively as "first groove 112"). First groove 112 may increase a first inner diameter across outer component 110, wherein first groove 112 may be configured to receive portions of expandable fastener 130 in a second mode.

Activation sleeve 120 may be configured to move along a linear axis along an inner circumference of outer component 110. Activation sleeve 120 may include a second groove 122, third groove 124, distal end 126, and proximal end 128.

Second groove 122 may be positioned on an outer circumference of activation sleeve 120, and may be a groove, recess, slot, indentation, etc. (referred to hereinafter individually and collectively as "second groove 122"). Second groove 122 may be configured to house expandable fastener 130 in the first mode and first groove 112 and second groove 122 may be misaligned from each other in the first mode. In the second mode, second groove 122 may be aligned with first groove 112 in the second mode, which may allow expandable fastener 130 to expand.

Third groove 124 may be positioned on an inner circumference of activation sleeve 120, and may have a profile that is configured to interface with an outer projection of a shifting tool. The profile of third groove 124 may include first end 150 and second end 152. First end 150 may have a sloped, tapered, angled sidewall that is slanted downward and towards a central axis of blank sub 100. This may enable the shifting tool to move downhole without engaging, shifting, interfacing with, etc. the activation sleeve 120 and without making the shifting sleeve shear. Second end 152 may have a flat sidewall or less tapered angle that extends in a direction perpendicular or steep to the central axis of blank sub 100. This may limit, restrict, etc. the shifting tool from moving up hole. This may enable the shifting tool to engage with third groove 124 to move activation sleeve 120 towards seat 140, and expand seat 140 and then shear.

Distal end 126 may be angled upward towards a central axis of blank sub 100, which may allow the shifting tool to move up hole without engaging or hanging on the activation sleeves 120 after the shifting tool shears.

Proximal end 128 may be angled upward away from the central axis of blank sub 100, and may be positioned adjacent to seat 140. This may enable activation sleeve 120 to apply forces against seat 140 to collapse seat 140.

Expandable fastener 130 may be a snap ring, retaining ring, etc. that is configured to expand based on a chamber housing expandable fastener 130. Expandable fastener 130 may be configured to be positioned within second groove 122 in the first mode, and having a first outer diameter. Responsive to moving activation sleeve 120 and aligning first groove 112 and second groove 122 in the second mode, expandable faster 130 may expand to have a second outer diameter. Further, in the second mode, expandable fastener 130 may be housed in both first groove 112 and second groove 122 in place. This may limit the movement of activation sleeve 120 in a first direction and second direction. By limiting the movement of activation sleeve 120, seat 140 may not be able to unset after activation sleeve 120 has moved to the second mode.

Seat 140 may be positioned adjacent of activation sleeve 120, and may be configured to collapse responsive to activation sleeve 120 applying pressure against seat 140. Responsive to seat 140 collapsing, an inner diameter of seat 140 may decrease from a first inner diameter to a second inner diameter. When seat 140 is sized to the first inner diameter, an object, such as a ball, may be positioned on seat 140. This may create a seal across the inner diameter of blank sub 100.

Figure 2:
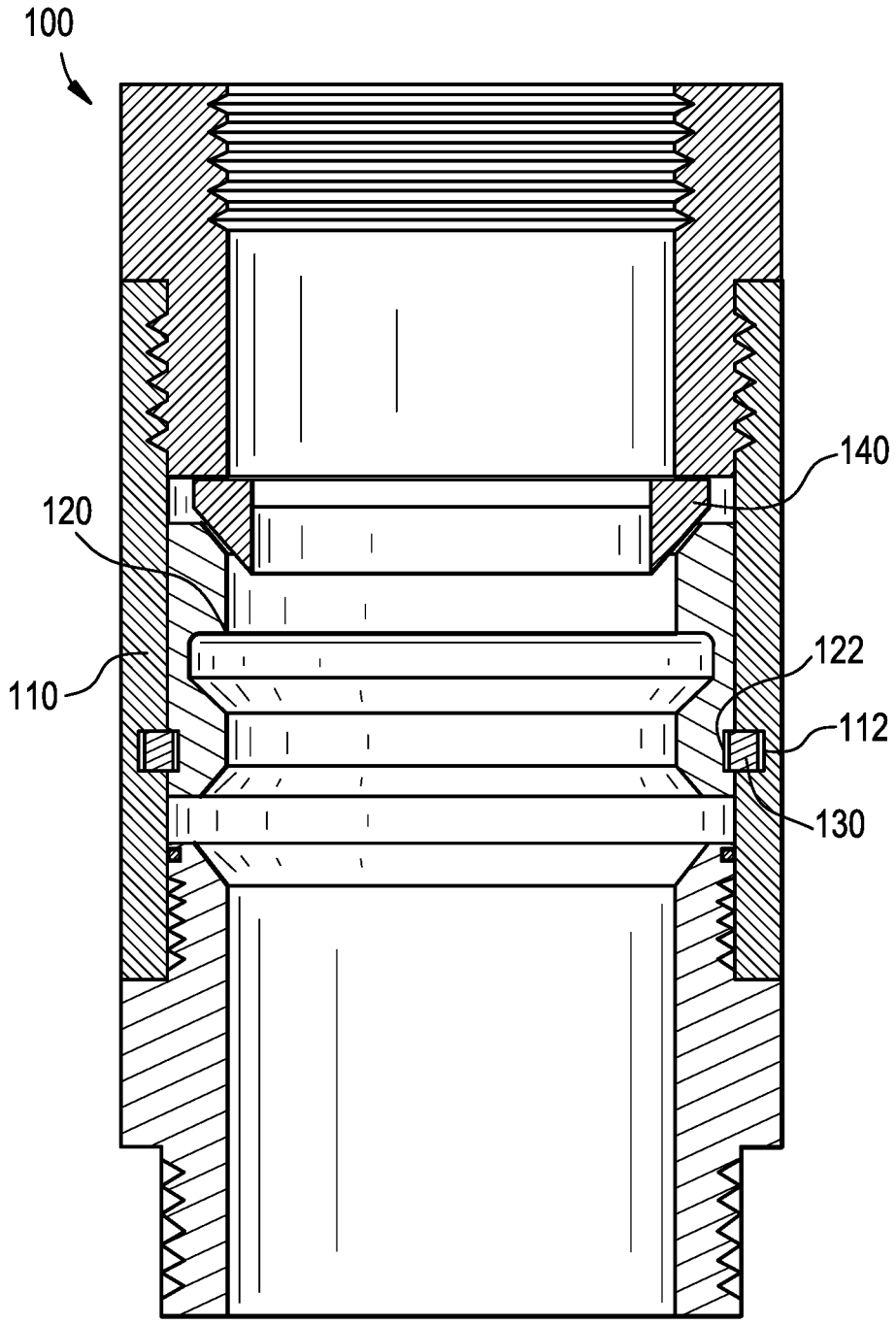
FIGS. 2 and 3 depict a blank sub once activated, according to an embodiment.
Figure 3:
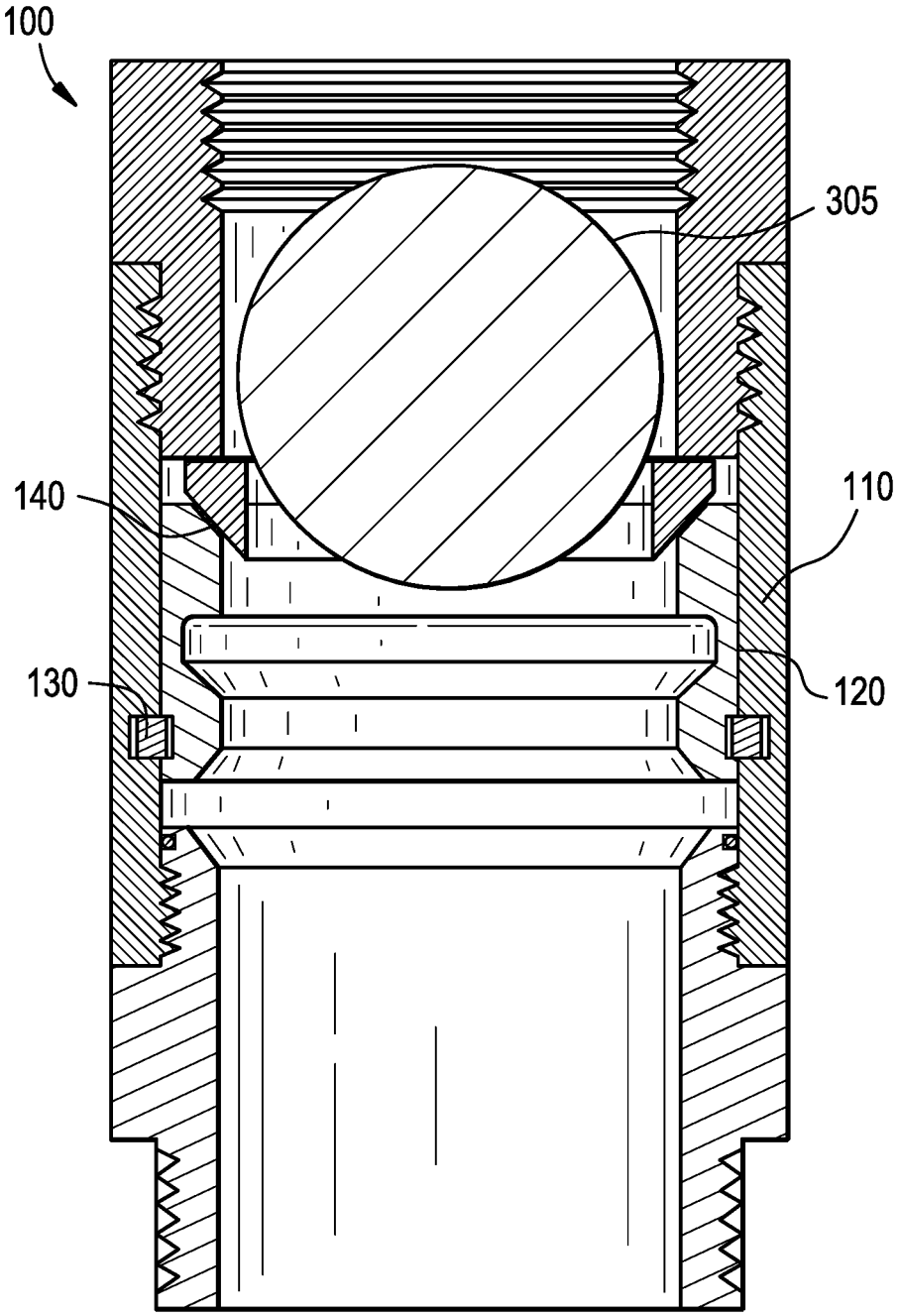

FIGS. 2 and 3 depicts blank sub 100 once activated, according to an embodiment.

As depicted in FIG. 2, by moving activation sleeve 120 towards ball seat 140, activation sleeve 120 may force ball seat 140 to collapse or otherwise move to decrease the inner diameter across ball seat 140.

As depicted in FIG. 3, this may enable a ball 305 or other object to form a seal across the inner diameter of blank sub 100.

Furthermore, once activation sleeve 120 is activated into the second mode, first groove 112 may be aligned with second groove 122. This may enable expandable fastener 130 to expand into activation sleeve 120 and outer component 110 to limit the movement of activation sleeve 120. By limiting the movement of activation sleeve 120, activation sleeve 120 may be retained in the second mode and lock the ball seat in collapsed position.

Figure 4:
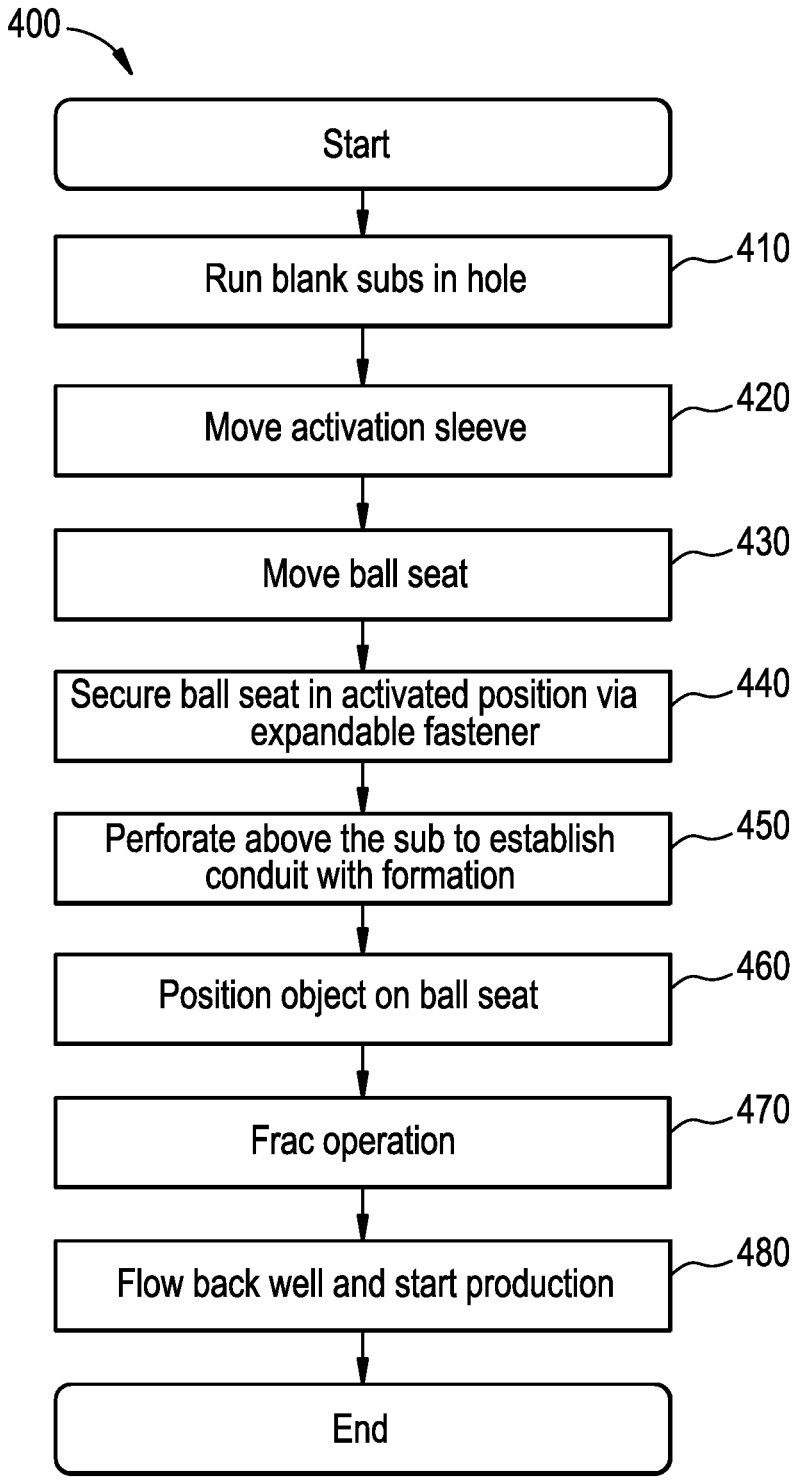
FIG. 4 depicts a method for utilizing a blank sub to replace a Frac Plug, according to an embodiment.

FIG. 4 depicts a method 400 for utilizing a blank sub to replace a Frac Plug, according to an embodiment. The operations of the method depicted in FIG. 4 are intended to be illustrative. In some embodiments, the method may be accomplished with one or more additional operations not described, and/or without one or more of the operations discussed. Additionally, the order in which the operations of the method are illustrated in FIG. 4 and described below is not intended to be limiting.

At operation 410, a plurality of blank subs may be run in hole, wherein each of the blank subs may be associated with a different zone or stage. Each of the plurality of blank subs may have substantially the same and continuous inner diameter when run in hole.

At operation 420, an activation sleeve may be moved from a first position to a second position. When the activation sleeve moves towards the second position, a groove within the activation sleeve holding an expandable fastener may become aligned with a groove within an outer component. This may allow the expandable fastener to expand, and be positioned within both grooves securing the activation sleeve in place.

At operation 430, while the activation sleeve moves towards the second position, an end of the activation sleeve may interface with a ball seat forcing an inner diameter associated with the ball seat to decrease in size. Furthermore, because the activation sleeve may be secured in place via the expandable fastener, the ball seat may be maintained in a positioned with the smaller inner diameter.

At operation 430, perforating guns that may be run above the shifting tool may be fired. This may a conduit with the formation positioned above the blank sub.

At operation 460, an object, such as a ball, may be positioned on the ball seat with the smaller inner diameter.

At operation 470, pressure within the blank sub above the object may be increased. However, even when the pressure increases, the expandable fastener may secure the activation sleeve in a locked position, which in turn maintains the ball seat in a positioned with the smaller inner diameter. The increase in pressure may allow fracing operation to start at the zone above the blank sub.

Figure 5:
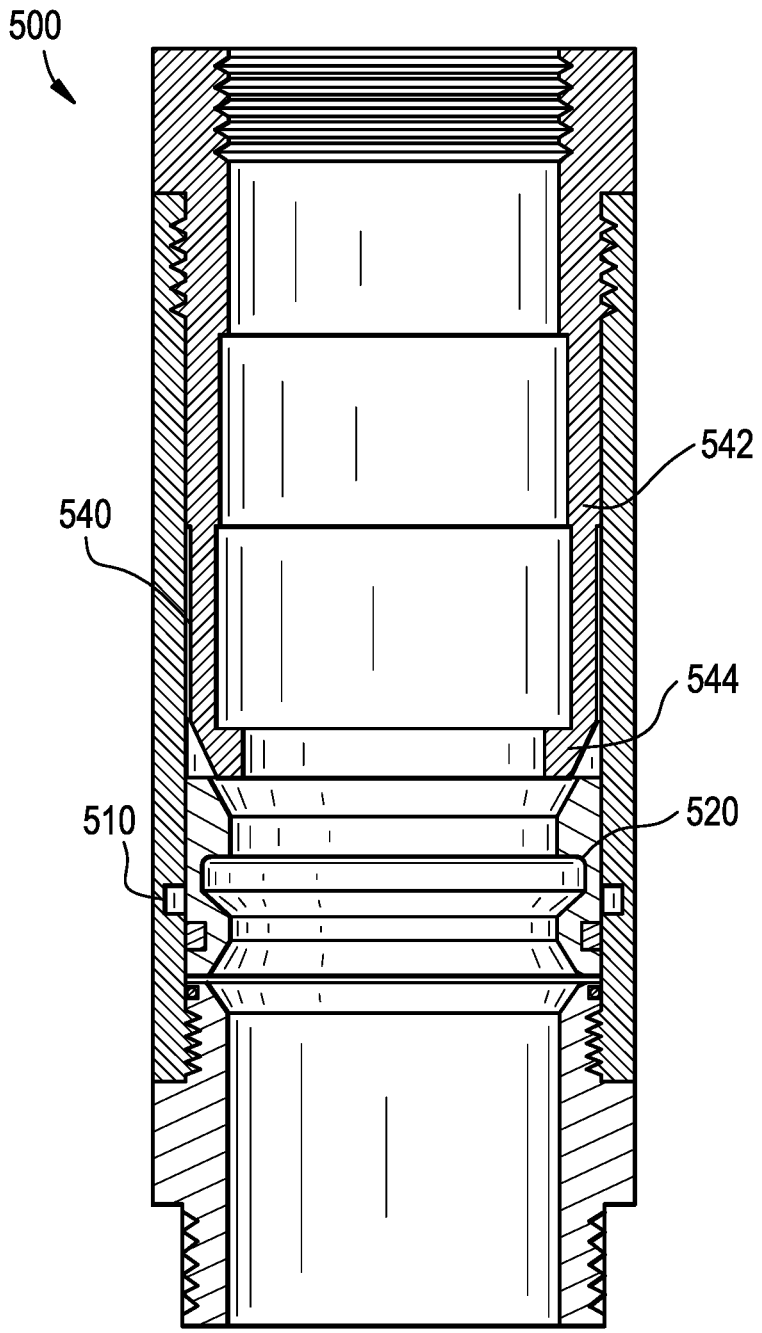
FIG. 5 depicts a blank sub, according to an embodiment.

At operation 480, after commencing fracing within all zones, the well may be put to production. This may allow the formation to flow back through the hollow chamber positioned within the blank sub, and all objects on positioned on the collapsed seats to be retrieved by flowing objects allowing with the flow back. In other embodiment, these objects may be dissolvable FIG. 5 depicts a blank sub 500, according to an embodiment. Elements depicted in blank sub 500 may be described above, and for the sake of brevity a further description of these elements may be omitted.

As depicted in FIG. 5, an activation sleeve 520 may be positioned adjacent to a collet 540. Collet 540 may have a shaft 542 and distal end 544. When run in hole, the shaft 542 and distal end 544 may be substantially aligned with the inner sidewall of an outer component 510. Responsive to activation sleeve 520 moving, a proximal end of activation sleeve 520 may interface with a lower surface of distal end 544, which may force distal end 544 to move inward. This may decrease an inner diameter across distal end 544, and allow an object to be positioned on distal end 544 to form a seal.

Figure 6:
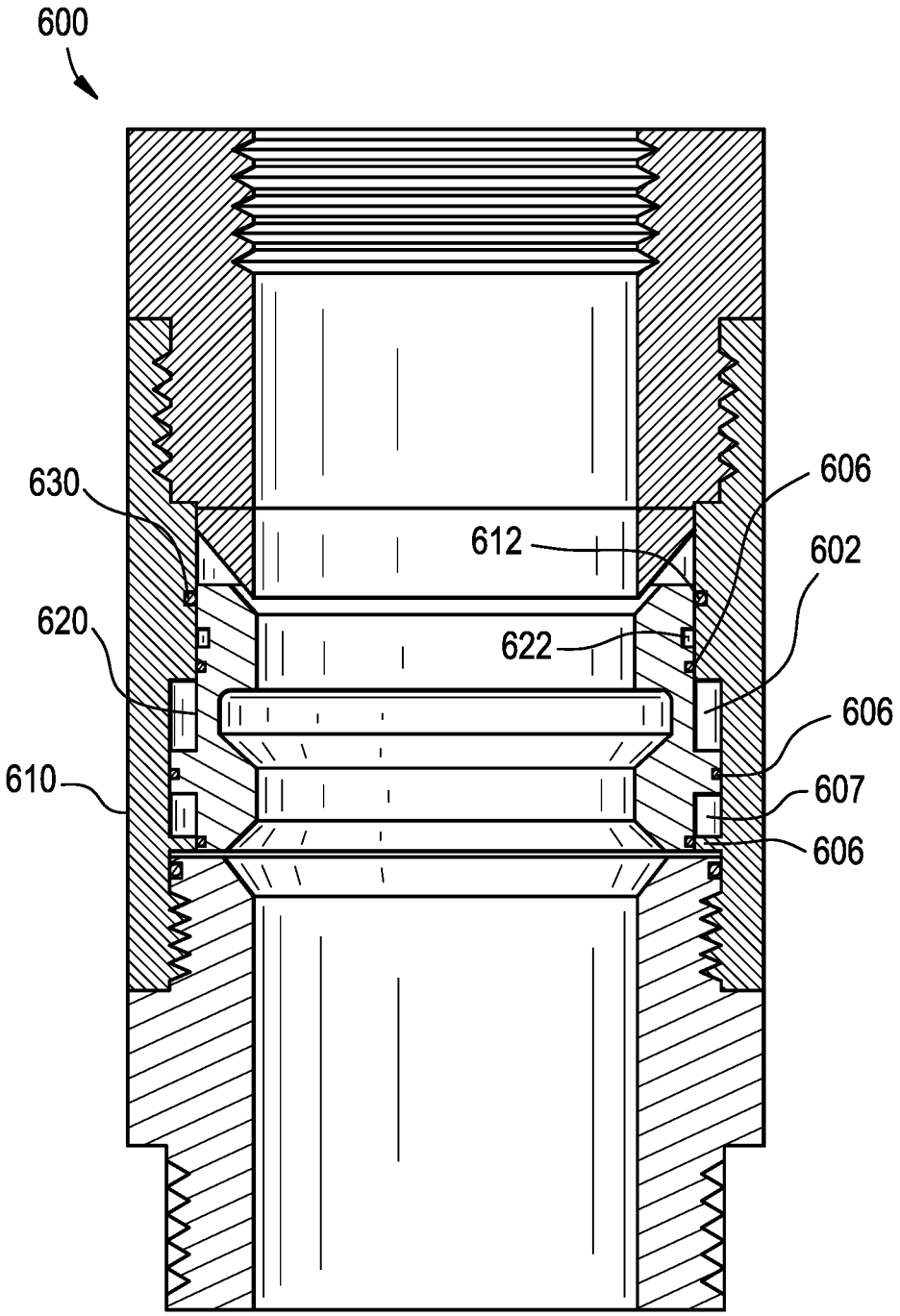
FIG. 6 depicts a blank sub, according to an embodiment.

FIG. 6 depicts a blank sub 600, according to an embodiment. Elements depicted in blank sub 600 may be described above, and for the sake of brevity a further description of these elements may be omitted. Blank sub 600 may utilize unbalanced piston areas 602, 607 to assist the movement of activation sleeve 620 against ball seat 640. This force may assist in situations where a shifting tool and its conveying methods may not be able to generate sufficient force to move activation sleeve 620.

As depicted in FIG. 6, blank sub 600 may include an atmospheric chamber 602. Atmospheric chamber 602 may be positioned between inner sidewalls of an outer component 610 and outer sidewalls of activation sleeve 620, and are initially sealed by a plurality of seals 606. In embodiments, atmospheric chambers 602 and 607 may be initially isolated from the pressure within a hollow chamber associated with blank sub 600 and an annulus.

As further depicted in FIG. 6, an expandable fastener 630 may initially be positioned within a groove 612 on the inner sidewall of outer component 610, which may be initially offset from a groove 622 on an outer sidewall of activation sleeve 620.

Figure 7:
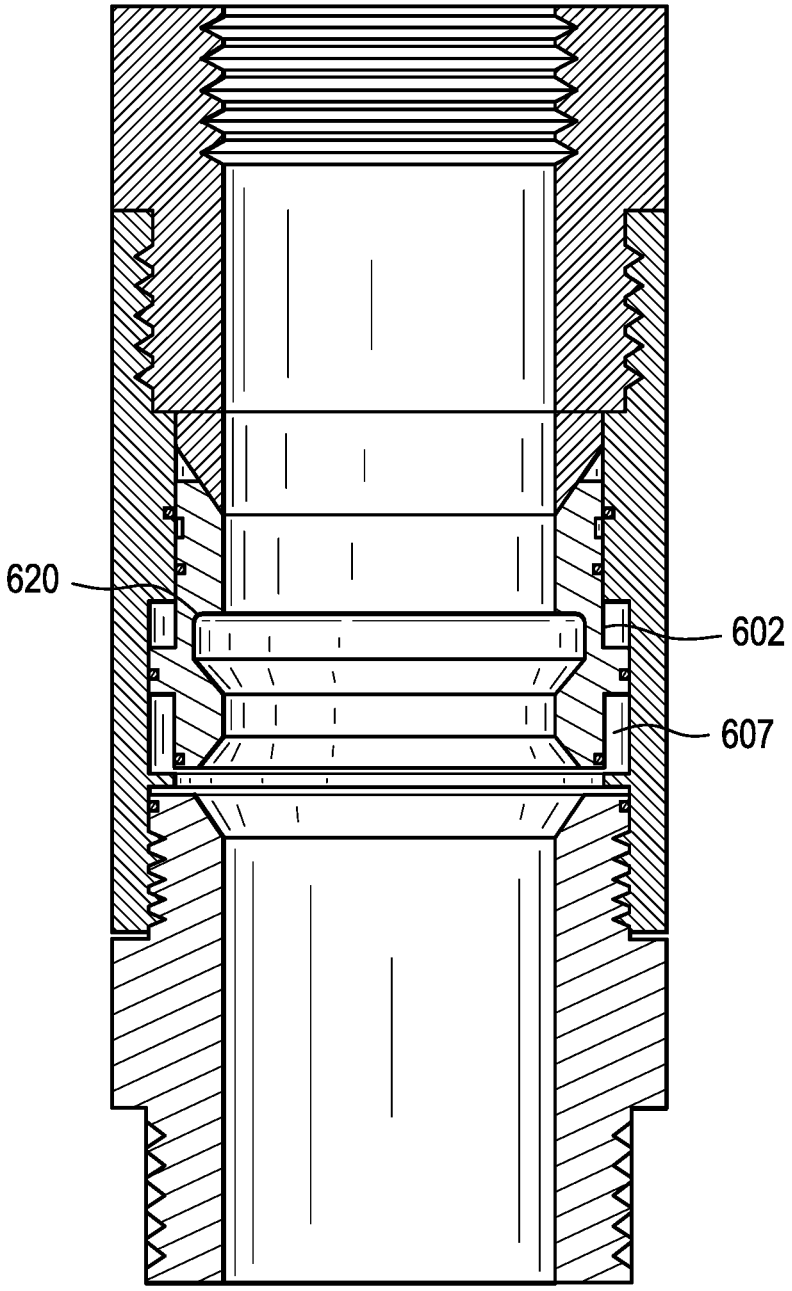
FIG. 7 depicts a blank sub in an initial activation stage, according to an embodiment.

FIG. 7 depicts a blank sub 600 in an initial activation stage, according to an embodiment. Elements depicted in blank sub 600 may be described above, and for the sake of brevity a further description of these elements may be omitted.

As depicted in FIG. 7, an activation sleeve 620 may move responsive to receiving a mechanical force from a shifting tool, which may expose atmospheric chamber 607 to the hollow chamber within blank sub 600. This may allow atmospheric chamber 607 to communicate with the hollow chamber, and be flooded. The pressure within the hollow chamber and the flooded chamber 607 may be greater than that of the sealed atmospheric chamber 602. The higher pressure in the hollow chamber and flooded chamber 607 may be either due to applied or function of hydrostatic head.

Figure 8:
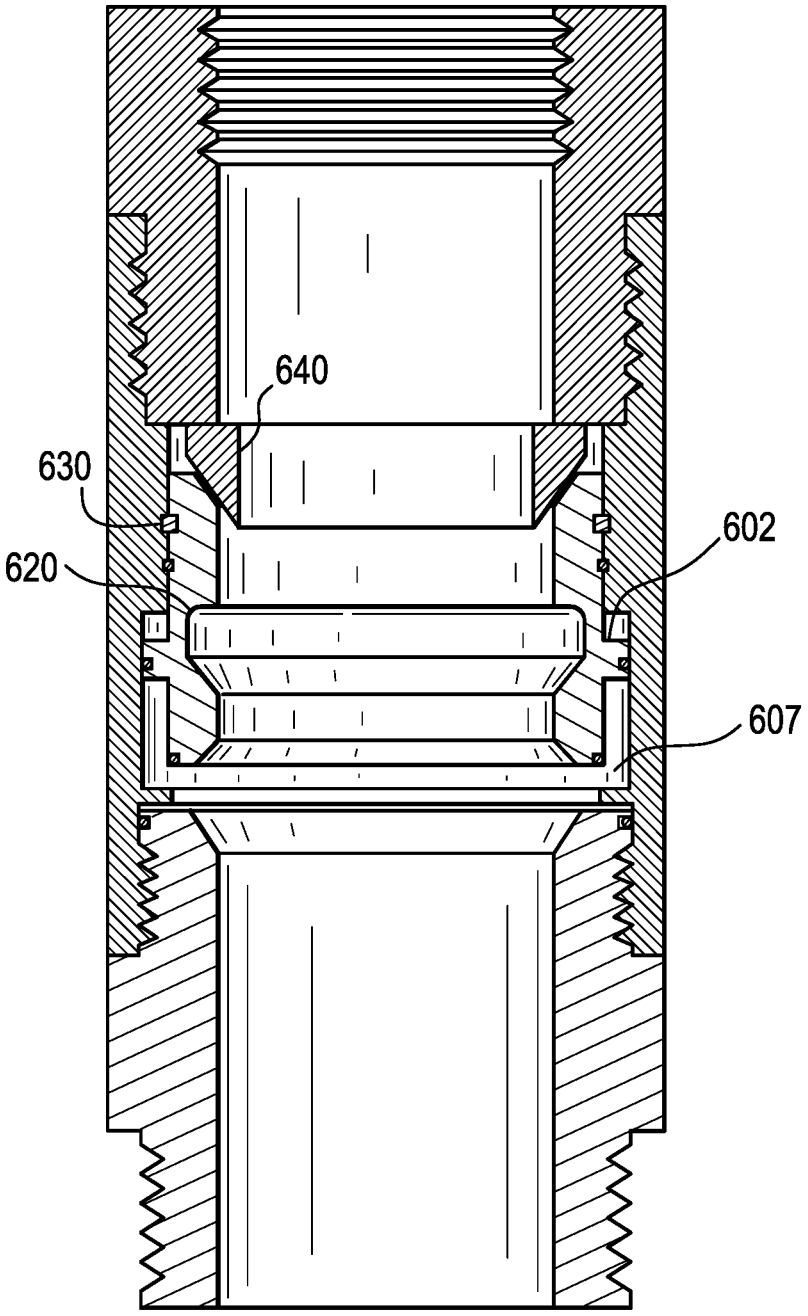
FIG. 8 depicts a blank sub in a second activation stage, according to an embodiment.

FIG. 8 depicts a blank sub 600 in a second activation stage, according to an embodiment. Elements depicted in blank sub 600 may be described above, and for the sake of brevity a further description of these elements may be omitted.

As depicted in FIG. 8, utilizing the unbalanced piston created by the atmospheric chamber 602 being flooded as opposed to being sealed, may allow activation sleeve 620 to move as it exerts force on atmospheric chamber 607. This may enable the groove within the inner sidewall of outer component 610 housing expandable fastener 630 to become aligned with the groove within the outer sidewall of activation chamber 602. Responsive to aligning the grooves, expandable fastener 630 may expand and secure activation sleeve 620 in place.

Furthermore, with the aid of the unbalanced piston and a mechanical force from a shifting tool, activation sleeve 620 may interface with a seat 640. This may cause seat 640 to collapse to have a smaller inner diameter.

Figure 9:
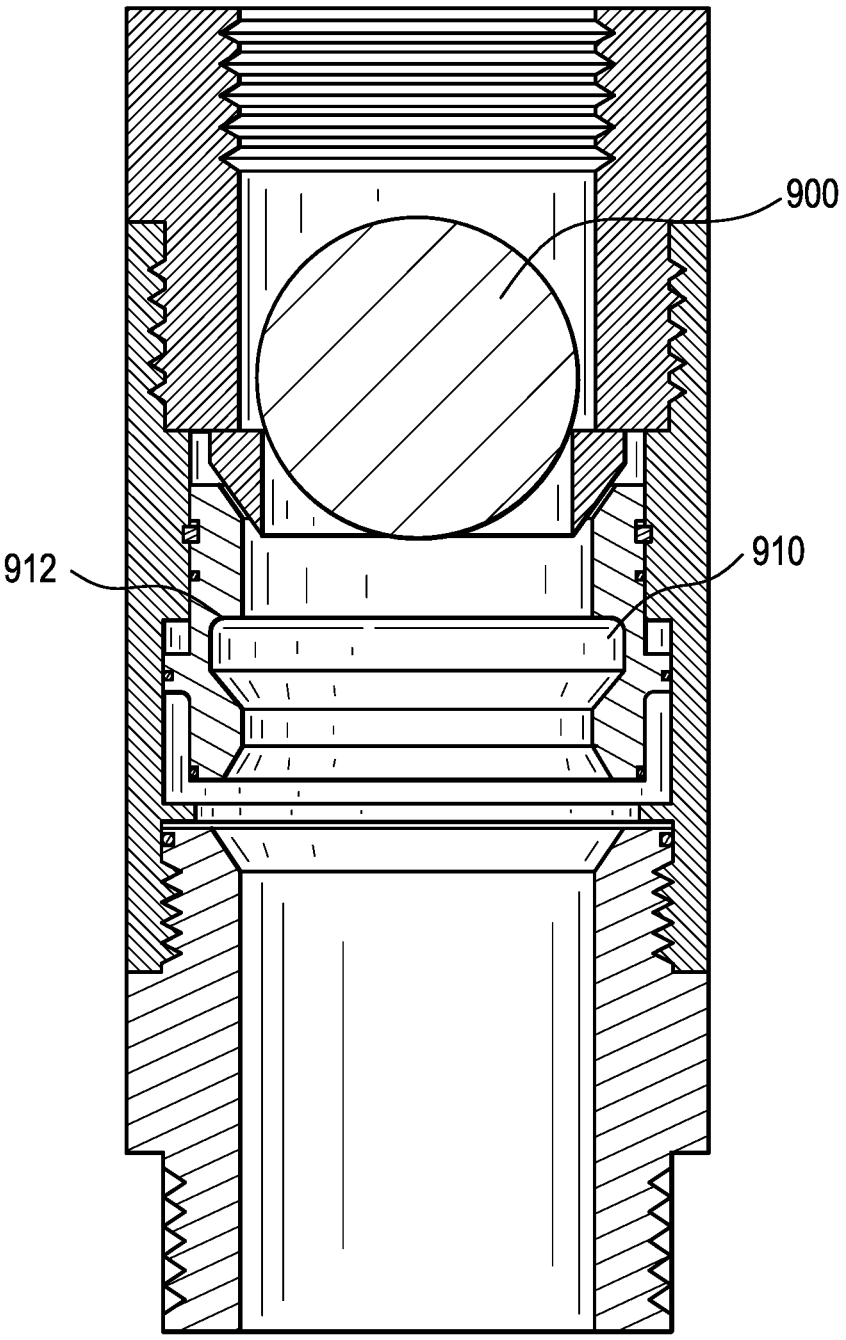
FIG. 9 depicts a blank sub, according to an embodiment.

FIG. 9 depicts a blank sub 600, according to an embodiment. Elements depicted in blank sub 600 may be described above, and for the sake of brevity a further description of these elements may be omitted.

As depicted in FIG. 9, responsive to moving activation sleeve 620 to correspondingly move and collapse seat 640, an object 900 may be positioned on seat 620, this may allow the perforated zone above the blank sub 600 to be treated and fraced in isolation of the zones below of the sub.

In further embodiments, grooves 910 positioned on the inner sidewall of activation sleeve 620 may have different profiles based on the location of blank sub 600 within a well. For the upper most blank sub 600 within a zone of multi blank subs 600 activated in the same run, certain grooves, profiles, etc. 910 may have an upper ledge 912 that is perpendicular or at steep angle with respect to the central axis of blank sub 600. For example, the last blank sub within the hole may have a groove with a no-go. This may allow groove 910 to operate as a no-go, stopper, etc. allowing a projection on a shifting tool to be inserted into groove 910, shift the activation sleeve 910 and then travel up hole, and removed from the groove without shearing the shifting tool.

However, other grooves 910 within different blank subs 900 may have an upper ledge 912 that is slightly upwardly sloped. This may allow the projections on the shifting tool to interface with groove to apply the mechanical force to move activation sleeve, creating the unbalanced piston, expanding the expandable faster, decreasing the inner diameter across the seat, and locking the activation sleeve in place, all without shearing the shifting tool.

Figure 10:
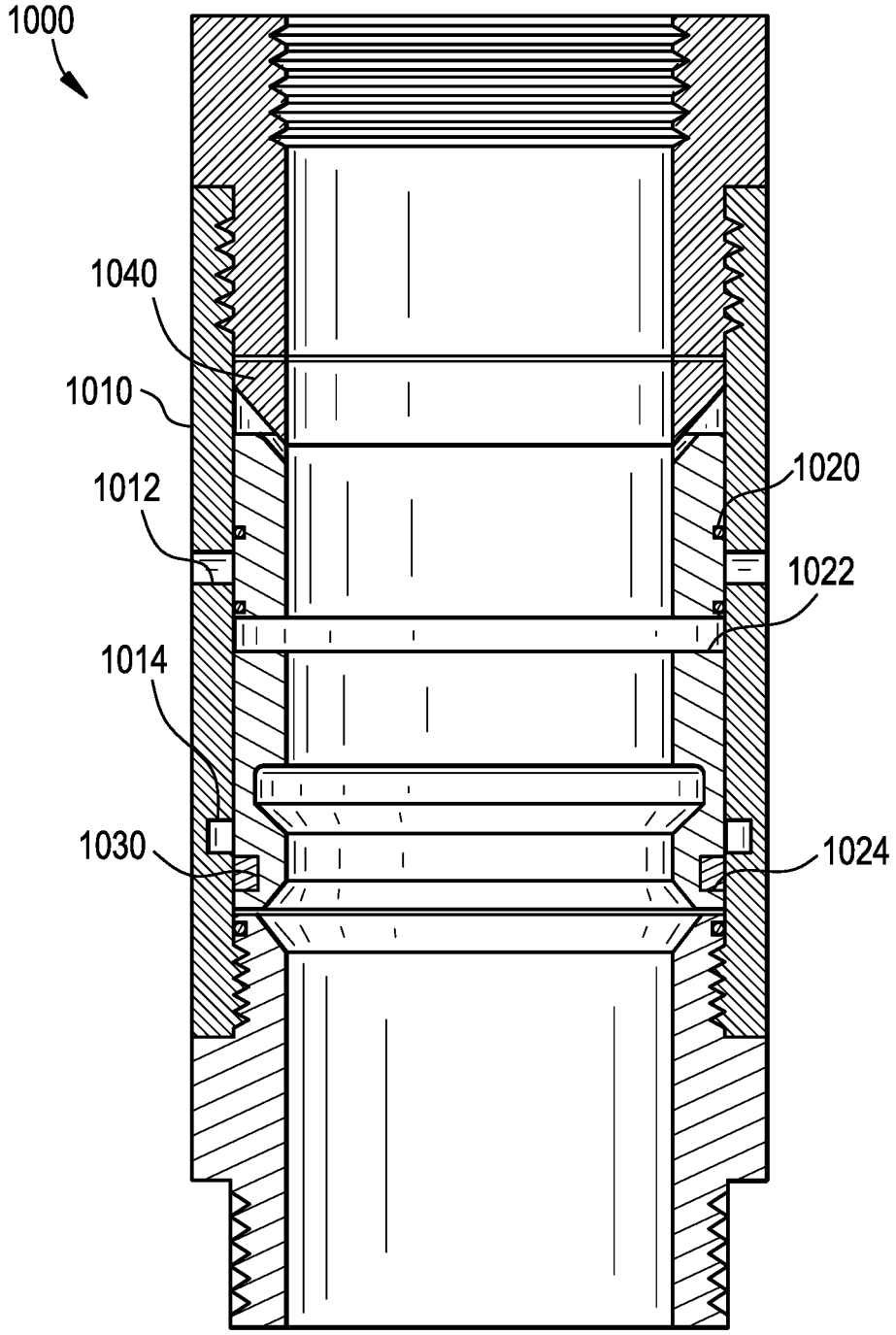
FIG. 10 depicts a sleeve, according to an embodiment.

FIG. 10 depicts a sleeve 1000, according to an embodiment. Elements depicted in FIG. 10 may be described above, and for the sake of brevity a further description of these elements may be omitted.

As depicted in FIG. 10, sleeve 1000 may have a similar profile as blank sub 100. However, activation sleeve 1020 may have a first port 1022, which is configured to move from a misaligned position to an aligned position with a second port 1012 within an outer component 1010. In embodiments, responsive to aligning a first groove 1024 positioned on an outer sidewall of activation sleeve 1020 with a second groove 1012 positioned on an inner sidewall of outer component 1010 via a shifting tool interfacing with a profile 1024 positioned on an inner sidewall of activation sleeve 1020 to mechanically move activation sleeve 1020, expandable fastener 1030 may expand within the aligned first groove 1024 and second groove 1022 and first port 1022 may be aligned with second port 1012.

In further implementations, a seat 1040 may be positioned closer to a proximal end of sleeve 1000 than activation sleeve 1020 with first groove.

Figure 11:
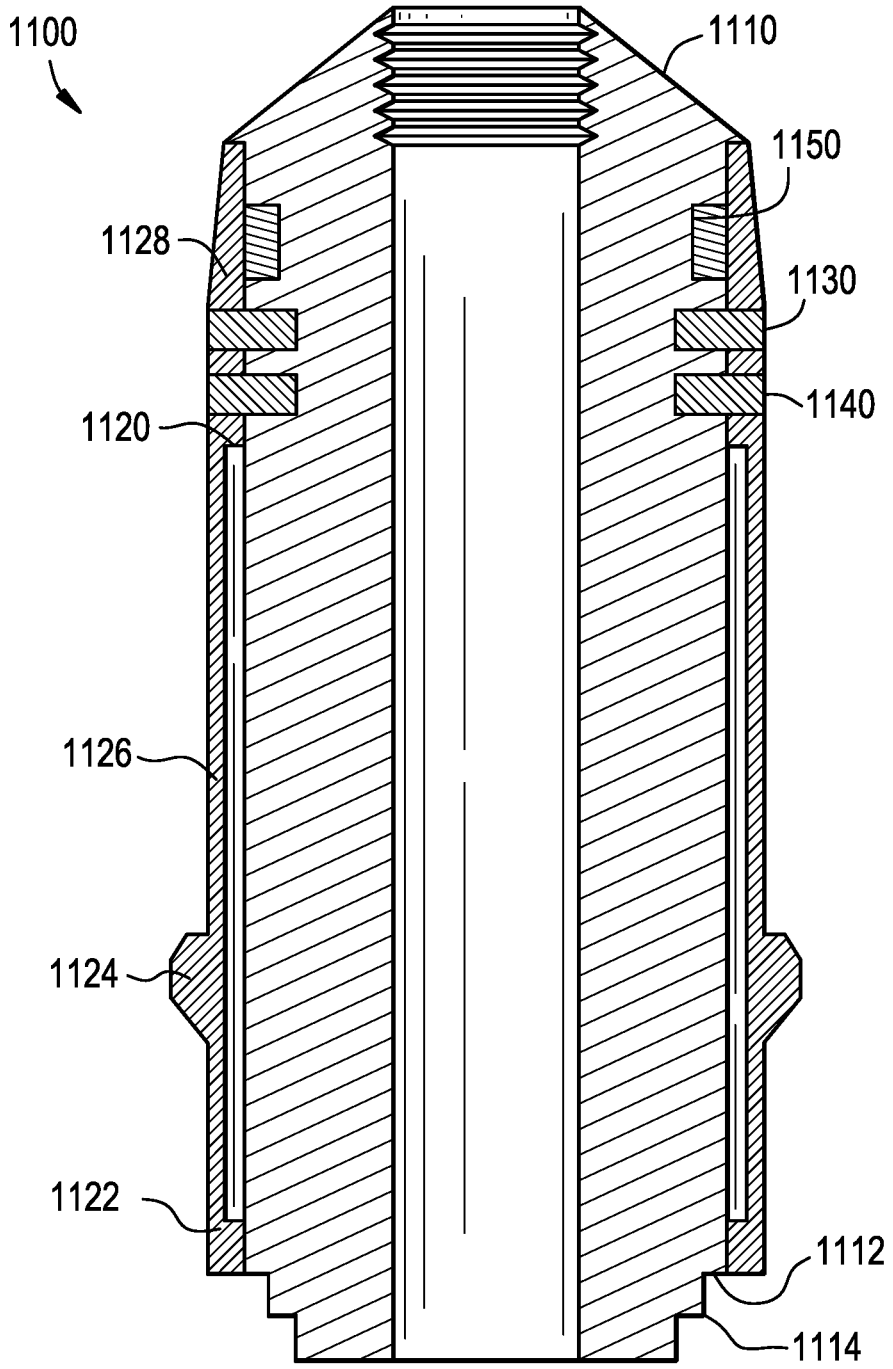
FIG. 11 depicts a shifting tool, according to an embodiment.

FIG. 11 depicts a shifting tool 1100, according to an embodiment. A profile of shifting tool 1100 may be configured to engage with a profile on an activation sleeve to apply a mechanical force against the activation sleeve in a first direction to move the activation sleeve in the first direction when the shifting tool 1100 moves in the first direction, while the profiles on the shifting tool 110 and the activation sleeve may allow the shifting tool 1100 to move in a second direction without moving the activation sleeve.

Shifting tool 1100 may be configured to be mounted below or above perforating guns, a pump down sub, or other elements. Shifting tool 1100 may be configured to run with a wireline, coiled tubing, slick line, pipe, etc. or any other conveyance method to activate a sleeve with a no-go ball seat, allowing the perforation guns to be fired in a single trip. However, shifting tool 1100 may be run with a slick line to perform the same job, and later run a wireline independently. Shifting tool 1100 may include an inner core 1110, shifting element 1120, first shearing pin 1130, second shearing pin 1140, and locking segment 1150. In other embodiments, the shifting tool may have spring-loaded segments that can collapse.

Inner core 1110 may be formed of a solid material or a dissolvable material or combination of both, and may be configured to be a structural support to secure shifting element 1120 in place. Inner core 1110 may include a first ledge 1112, and second ledge 1114.

Ledges 1112 and 1114 may be positioned proximate to a distal end of inner core 1110, and may be indentations extending from an outer sidewall of inner core 1110 towards a central axis of shifting tool 1100. First ledge 1112 and second ledge 1114 may be configured to extend in a direction that is perpendicular to the central axis of inner core 1110. Ledges 1112, 1114 may be configured to interface with an inner profile 1122 on shifting element 1120 to restrict the movement of an inner diameter across shifting element 1120. In other embodiments, the ledges can be positioned in any position proximate to closer end of inner core 1110.

First ledge 1112 may have a first outer diameter, and second ledge 1114 may have a second outer diameter, wherein the first outer diameter is larger than the second outer diameter. Further, first ledge 1112 may be positioned further from a distal end of inner core 1110 than second ledge 1114. First ledge 1112 may be configured to interface with inner profile 1122 responsive to first shearing pin 1130 shearing, and second ledge 1112 may be configured to interface with inner profile 1122 responsive to second shearing pin 1140 shearing.

Shifting element 1120 may be a tool that is comprised of solid materials, dissolvable materials, or any type of material or combination of material. Shifting element may include a proximal end 1128, shaft 1126, inner profile 1122, and outer profile 1124. In other embodiments, the shifting element 1120 may be spring loaded expandable segments.

Proximal end 1128 of shifting element 1120 may be configured to be selectively coupled to inner core 1110 via first shear pin 1130, second shear pin 1140, and locking segment 1150.

Shaft 1126 may be configured to extend from proximal end 1128 to inner profile 1122. Shaft 1126 may be configured to flex, bend, etc. to have a variable inner diameter based on the positioning of inner profile 1122 being positioned adjacent to a sidewall of inner core, within first ledge 1112 and outer profile 1124, or within second ledge 1114. In embodiments, shaft 1126 may have larger inner diameter when inner profile 1122 is positioned adjacent to a portion of inner core 1110 with a larger inner diameter.

Inner profile 1122 may be positioned on an inner sidewall of the distal end of shifting element 1120. Inner profile 1122 may have an upper surface that extends in a direction perpendicular to the central axis of shifting tool 1100. Inner profile 1122 may be configured to be adjacent to a sidewall of inner core 1110 when run in hole, be positioned adjacent to first ledge 1112 responsive to first shearing pin 1130 shearing, and adjacent to second ledge 1114 responsive to second shearing pin 1140 shearing. Inner profile 1122 may be configured to retain the distal end of shifting element 1120 in place to maintain the inner diameter across shaft 1126.

Outer profile 1124 may be positioned on an outer sidewall of shaft 1126, and may be configured to interface with a profile of an activation sleeve. An upper surface of outer profile 1124 may be positioned perpendicular or at steep angle to a central axis of shifting tool 1100. A lower surface of outer profile 1124 may be downwardly tapered with respect to a central axis of shifting tool 1100. This may restrict the movement of shifting element 1120 in a first direction, while allowing the movement of shifting element 1120 in a second direction. In further embodiments, the upper surface of outer profile 1124 may be tapered to allow movement in the first direction based on the profile of the activation sleeve. This may allow shifting element 1120 to interface with multiple sleeves in a single trip.

In embodiments, responsive to engaging outer profile 1124 with a profile of an activation sleeve and applying a force against the activation sleeve in a first direction, first shearing pin 1130 may shear and the activation sleeve may move to activate the ball seat within a sub. This may allow inner profile 1112 to interface with first ledge 1112 to decrease the diameter across shifting tool 1120. When the diameter across shifting tool 1120 is decreased, outer profile 1124 may move towards a central axis of shifting tool 1100 and no longer be engaged with the profile of the activation sleeve, allowing shifting element 1120 to move in the first direction. When further moving shifting element 1120 in the first direction, outer profile 1124 may engage with the ball seat, which when activated has a smaller inner diameter than that of the activation sleeve. Responsive to further moving shifting element 1120 in the first direction, second shearing pin 1140 may shear, which may indicate that the ball seat is activated and ready to accept an object.

First shear pin 1130 and second shearing pin 1140 may be configured to selectively couple shifting element 1120 to inner core 1110 at a first location and a second location, respectfully. First shearing pin 1130 may be configured to be pre-loaded when run in hole. Second shearing pin 1140 may not be pre-loaded when run in hole, and may be configured to be loaded based on the movement of shifting element 1120 and shearing of first shearing pin 1130. As such, first shearing pin 1130 may be configured to be sheared responsive to outer profile 1124 engaging with a profile on an activation sleeve, which may load second shearing pin 1140. This loading of second shearing pin 1140 may enable second shearing pin 1140 to be sheared, and validate the activation of a ball seat. In other embodiments, the shear pins may be any other temporary coupling mechanism, i.e.: shear ring, dissolvable pins, dissolvable material, etc.

Locking segment 1150 may be configured to secure and hold shifting element 1120 in a retracted position once shifting tool 1100 is activated. This may act as a retainer to keep the outer diameter of shifting element 1120 in a collapsed position post shearing of the shearing pins 1130, 1140.

FIGS. 12-15 depict shifting tool 1100 in various positioning. Elements depicted in FIGS. 12-15 may be described above, and for the sake of brevity a further descriptions of these elements may be omitted.

Figure 12:
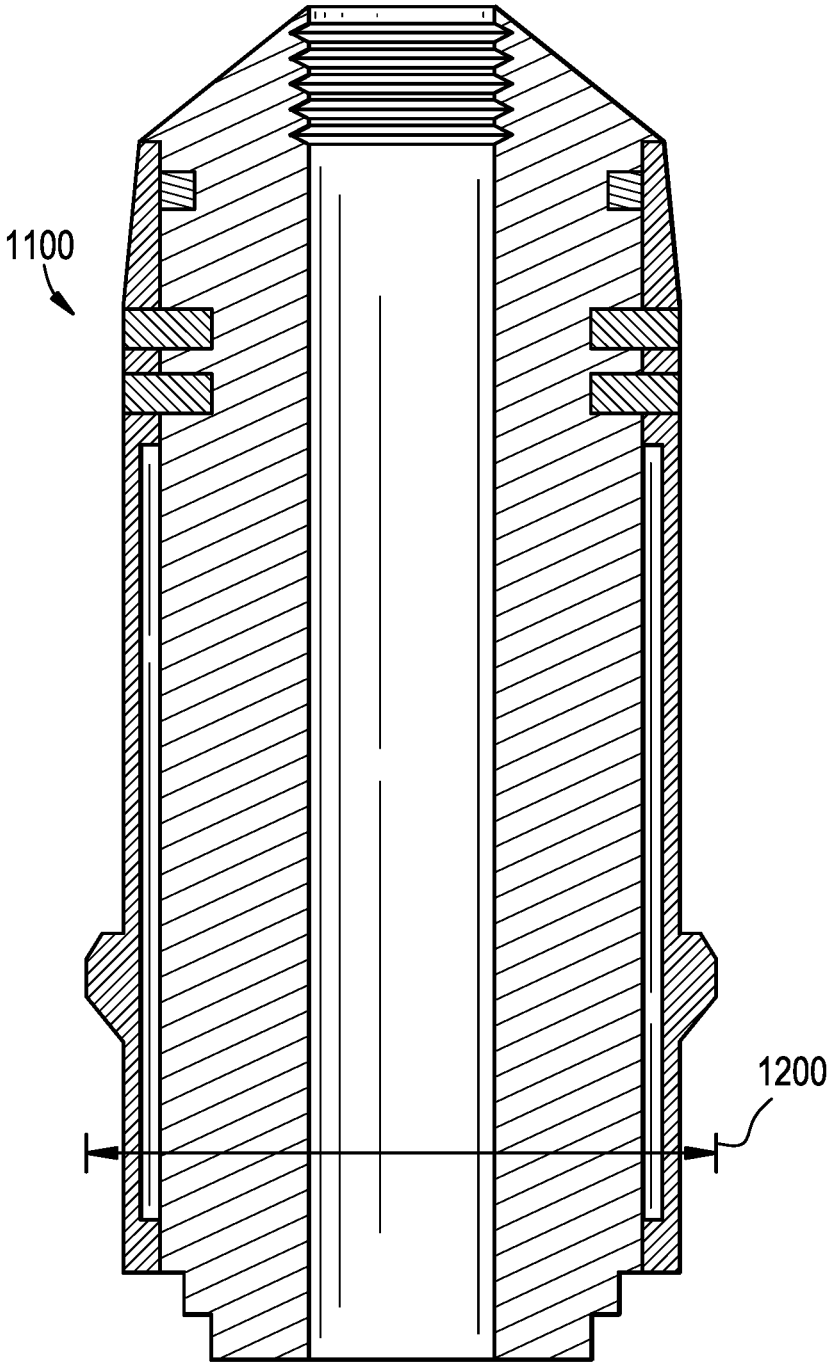
FIGS. 12-15 depict a shifting tool in various positioning, according to an embodiment.

As depicted in FIG. 12, when shifting tool 1100 is run in hole, an outer diameter 1200 of shifting tool 1100 may be a first distance.

Figure 13:
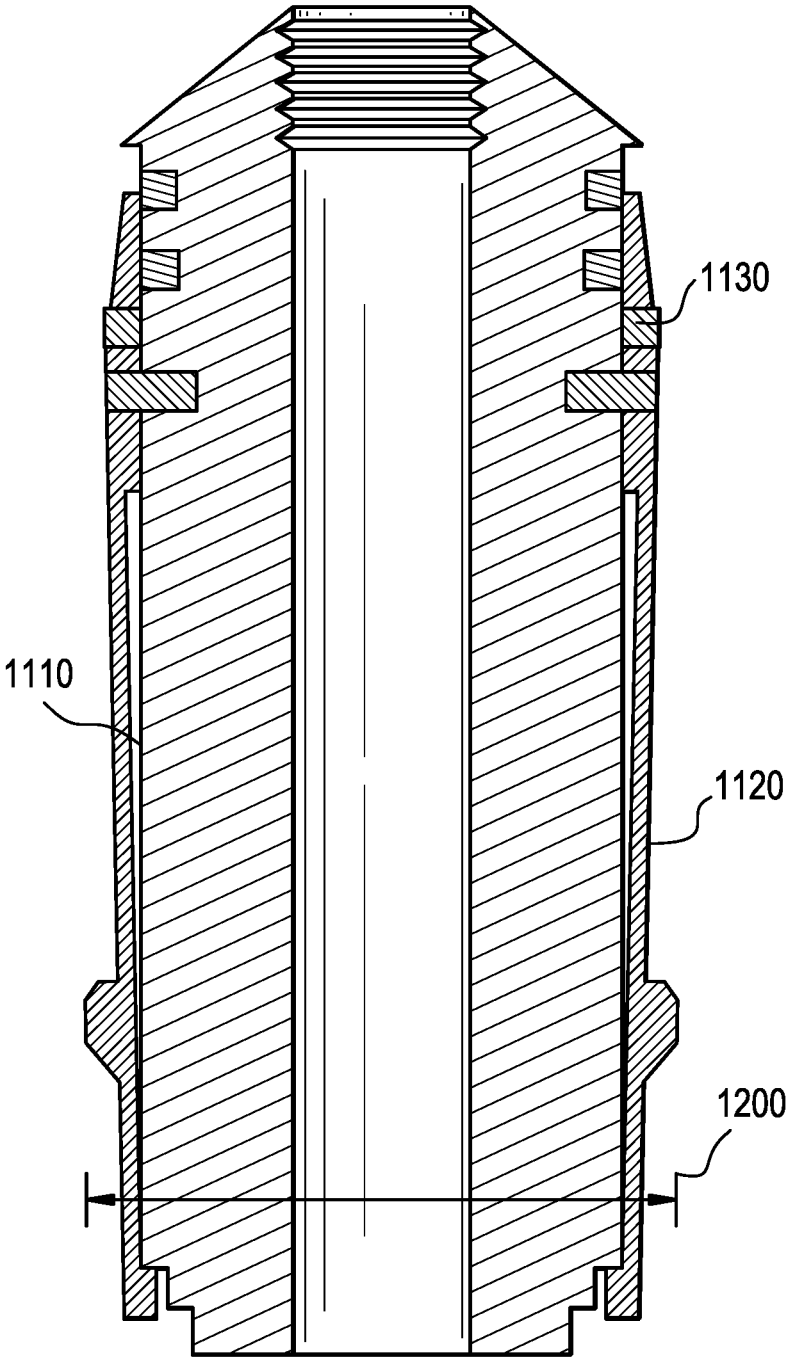

As depicted in FIG. 13, responsive to first shearing pin 1130 shearing, allowing shifting element 1120 to move relative to inner core 1110, the outer diameter 1200 of shifting tool 1100 may decrease. This may allow shifting tool 1100 to move in a first direction past an activation sleeve.

Figure 14:
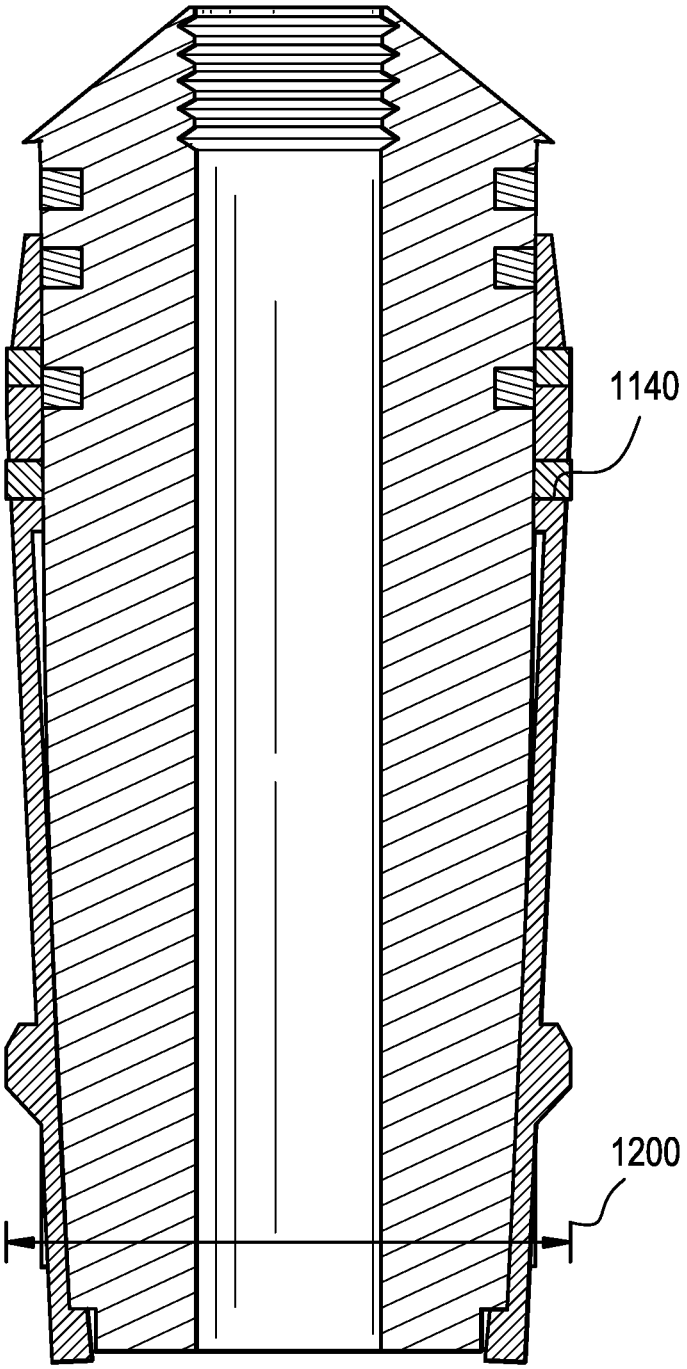

As depicted in FIG. 14, responsive to second shearing pin 1140 shearing, allowing shifting element 1120 to move relative to inner core 1110, the outer diameter 1200 of shifting tool 1100 may further decrease. This may allow shifting tool 1100 to move in a first direction past an activated ball seat.

Figure 15:
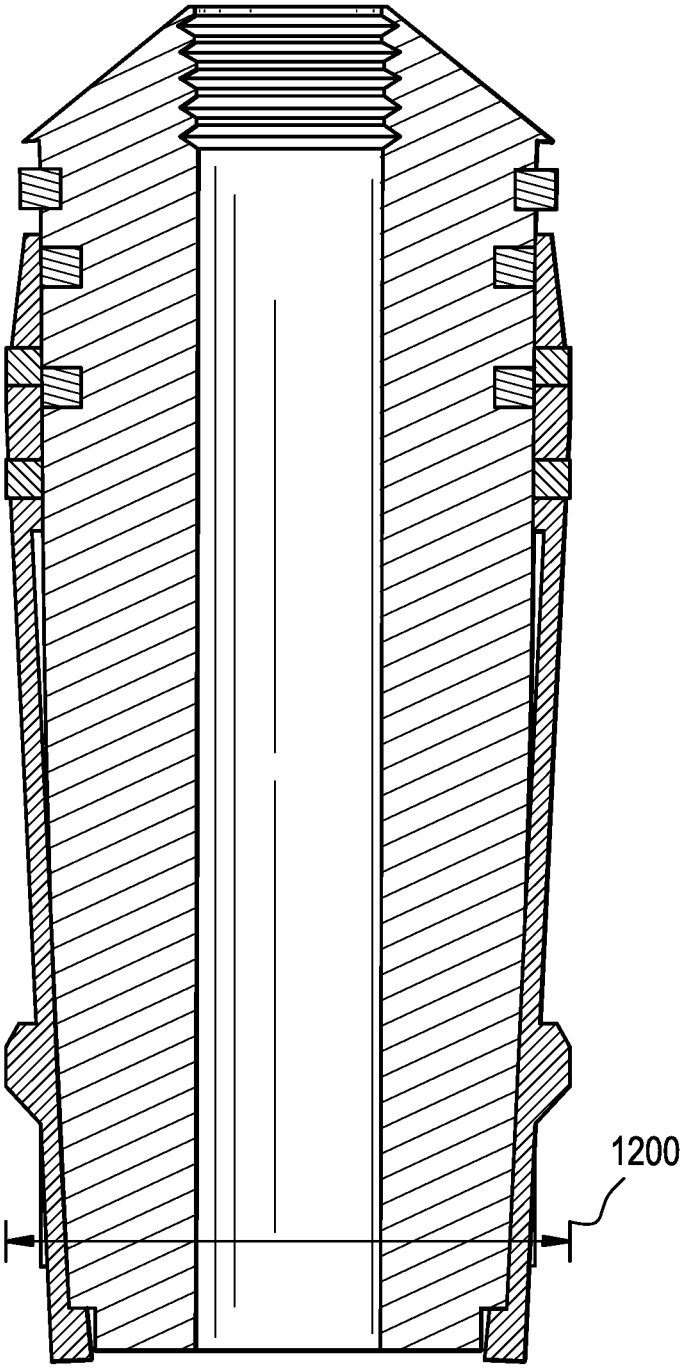

As depicted in FIG. 15, responsive to the outer diameter 1200 of shifting tool 1100 decreasing, shifting tool 1100 may be pulled out of hole.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A downhole tool comprising:

an outer component with a first groove;

an activation sleeve with a second groove and an inner profile;

an expandable fastener configured to expand across the first groove and the second groove to secure the activation sleeve in place;

a seat configured to have a decreased inner diameter responsive to moving the activation sleeve in a first direction and aligning the first groove and the second groove;

a shifting element with an outer profile, the outer profile being configured to interface with the inner profile of the activation sleeve to move the activation sleeve in the first direction, the shifting element being configured to bypass and not interface with the inner profile of the activation sleeve when the shifting element moves in a second direction, the first direction and second direction being opposite directions.

2. The downhole tool of claim 1, further comprising:

an atmospheric chamber that is positioned between an outer diameter of the activation sleeve and an inner diameter of the outer component, wherein the atmospheric chamber is configured to be sealed when run in hole.

3. The downhole tool of claim 1, wherein an atmospheric chamber is configured to be exposed responsive to moving the activation sleeve in the first direction, wherein exposing the atmospheric chamber creates an unbalanced piston that assists in moving the activation sleeve in the first direction.

4. The downhole tool of claim 1, wherein the outer component has a second port and the activation sleeve has a first port, the first port and the second port being configured to be aligned when the first groove and the second groove are aligned.

5. The downhole tool of claim 1, further comprising: an inner core being selectively coupled to the shifting element via a first shearing pin and a second shearing pin.

6. The downhole tool of claim 5, wherein the first shearing pin is pre-loaded before shifting element is run in hole, and the second shearing pin is loaded responsive to the first shearing pin being sheared.

7. The downhole tool of claim 6, wherein the inner core includes a first ledge and a second ledge, the first ledge having a first inner core outer diameter, and the second ledge having a second inner core outer diameter, the second inner core diameter being smaller than the first inner core inner diameter.

8. The downhole tool of claim 7, wherein a distal end of the shifting element includes an inner projection, the inner projection being configured to be positioned adjacent to a sidewall of the inner core when the first shearing pin and the second shearing pin are intact, the inner projection being configured to be interfaced with the first ledge responsive to the first shearing pin being sheared, and the inner projection being configured to be interfaced with the second ledge responsive to the first shearing pin being sheared.

9. The downhole tool of claim 6, wherein the first shearing pin is configured to shear responsive to the outer profile applying a force against the inner profile, and the second shearing pin is configured to shear responsive to the inner profile applying a force against the seat, wherein an outer diameter across the outer profile is configured to decrease to a first distance responsive to the first shearing pin shearing, and the outer diameter across the outer profile is configured to decrease from the first distance to a second distance responsive to the second shearing pin shearing.

10. The downhole tool of claim 4, wherein the inner core includes at least one of steel, dissolvable, composite or a combination of more than one material.

11. The downhole tool of claim 4, wherein the shifting tool can shift a plurality of activation sleeves before shearing, and the shifting tool is configured to collapse at an activation sleeve positioned closest to an entrance of a wellbore.

12. The downhole tool of claim 1, wherein one or more activation sleeves have the inner profile, and the one or more activation sleeves are configured to be shifted with a same shifting tool, wherein the shifting tool is configured to activate a lowest activation sleeve, and activate and shear at an activation sleeve positioned closest to an entrance of the wellbore.

13. The downhole tool of claim 1, where the seat is a collapsible seat.

14. A method for utilizing a downhole tool, the method comprising:

aligning a first groove positioned within an outer component with a second groove positioned within an activation sleeve, the activation sleeve including an inner profile;

expanding an expandable fastener across the first groove and the second groove to secure the activation sleeve in place responsive to aligning the first groove and the second groove;

decreasing an inner diameter associated with a seat responsive to moving the activation sleeve in a first direction and aligning the first groove and the second groove;

moving the activation sleeve in the first direction via a shifting element by interfacing an outer profile of the shifting element with the inner profile of the activation sleeve to move the activation sleeve in the first direction; the shifting element bypassing and not interfacing with the inner profile of the activation sleeve when the shifting element moves in a second direction, the first direction and second direction being opposite directions.

15. The method of claim 14, further comprising: forming an atmospheric chamber positioned between an outer diameter of the activation sleeve and an inner diameter of the outer component, wherein the atmospheric chamber is configured to be sealed when run in hole.

16. The method of claim 14, further comprising: exposing an atmospheric chamber responsive to moving the activation sleeve in the first direction, wherein exposing the atmospheric chamber creates an unbalanced piston that assists in moving the activation sleeve in the first direction.

17. The method of claim 14, wherein the outer component has a second port and the activation sleeve has a first port, aligning the first port and the second port when the first groove and the second groove are aligned.

18. The method of claim 14, further comprising: selectively coupling an inner core with the shifting element via a first shearing pin and a second shearing pin.

19. The method of claim 18, further comprising: preloading the first shearing pin before shifting element is run in hole, and loading the second shearing pin from an unloaded position responsive to the first shearing pin being sheared.

20. The method of claim 19, wherein the inner core includes a first ledge and a second ledge, the first ledge having a first inner core outer diameter, and the second ledge having a second inner core outer diameter, the second inner core diameter being smaller than the first inner core inner diameter.

21. The method of claim 20, wherein a distal end of the shifting element includes an inner projection, the inner projection being configured to be positioned adjacent to a sidewall of the inner core when the first shearing pin and the second shearing pin are intact, interfacing the inner projection with the first ledge responsive to the first shearing pin being sheared; and interfacing the inner projection with the second ledge responsive to the first shearing pin being sheared.

22. The method of claim 20, further comprising: shearing the first shearing pin responsive to the outer profile applying a force against the inner profile; and shearing the second shearing pin responsive to the inner profile applying a force against the seat; decreasing an outer diameter across the outer profile to decrease to a first distance responsive to the first shearing pin shearing, and decreasing the outer diameter across the outer profile from the first distance to a second distance responsive to the second shearing pin shearing.

23. The method of claim 14, wherein the inner core includes at least one of steel, dissolvable, composite or a combination of more than one material.

24. The method of claim 14, further comprising: shifting, via the shifting tool, a plurality of activation sleeves before shearing; and collapsing the shifting tool at a blank sub positioned closest to an entrance of a wellbore.

25. The method of claim 14, wherein one or more activation sleeves have the inner profile, and shifting the one or more activation sleeves with a same shifting tool, wherein the shifting tool is configured to activate a lowest most activation sleeve, and activate and shear at an activation sleeve positioned closest to an entrance of the wellbore.

26. The method of claim 14, where the seat is a collapsible seat.

* * * * *